US005133142A

United States Patent [19]

Peters

[11] Patent Number: 5,133,142

[45] Date of Patent: Jul. 28, 1992

[54] MULTI-CALIBER FIREARM

[76] Inventor: Franz-Josef Peters, Weierstrassweg 2, 4790 Paderborn, Fed. Rep. of Germany

[21] Appl. No.: 687,189

[22] Filed: Apr. 18, 1991

[30] Foreign Application Priority Data

Apr. 23, 1990 [DE] Fed. Rep. of Germany ..... 4012881

[51] Int. Cl.[5] ..... F41A 15/14

[52] U.S. Cl. ..... 42/25; 42/77

[58] Field of Search ..... 42/25, 77; 89/29

[56] References Cited

U.S. PATENT DOCUMENTS

| | | | |
|---|---|---|---|
| 2,711,041 | 6/1955 | Harvey | 42/25 |
| 3,431,669 | 3/1969 | Morrow | 42/25 |
| 3,680,240 | 8/1972 | Barr et al. | 42/25 |
| 3,771,415 | 11/1973 | Into et al. | 42/25 |
| 3,791,060 | 2/1974 | Weaver | 42/25 |
| 4,253,377 | 3/1981 | Arnett | 42/25 |
| 4,920,676 | 5/1990 | Peters | 42/25 |

FOREIGN PATENT DOCUMENTS 8709136.4 7/1987 Fed. Rep. of Germany .

*Primary Examiner*—Michael J. Carone

*Attorney, Agent, or Firm*—Foley & Lardner

[57] ABSTRACT

A multi-caliber firearm includes a breech, a pull-out claw at least partially disposed within the breech, and an adapter piece which is adjustably attached to the breech and onto which is formed a bearing surface which is located radially opposite the pull-out claw. The pull-out claw is capable of selectively engaging a cartridge case having a cartridge base. The position of the adapter piece is adjustable to enable the breech to accommodate cartridge cases having different cartridge base diameters. The adjustment of the adapter piece may be performed via rotation of an adapter piece formed with a plurality of steps ascending in a circumferential direction of the adapter piece, of via rotating an adapter piece which is screwed into the threaded bore and which moves radially with rotation of the adapter piece.

21 Claims, 3 Drawing Sheets

MULTI-CALIBER FIREARM

BACKGROUND OF THE INVENTION

The invention relates to a multi-caliber firearm having a breech and a device for varying the effective diameter of the breech to accommodate ammunition having different cartridge base diameters.

A multi-caliber pistol which can be converted to different projectile calibers by exchanging the barrel is described in German utility model 8709136. Since the cartridges used for the various barrels also differ in terms of the diameter of the cartridge base, a resilient holding claw is provided in the known pistol which is arranged on the side located opposite the pull-out claw of the breech and which constitutes an elastically flexible abutment for the edge of the cartridge base. The pull-out system of the breech is thus automatically matched to the particular diameter of the cartridge base, so that one and the same breech can be used for all types of ammunition.

In this known solution, however, the production and assembly of the resilient holding claw involve a relatively high outlay. The contour of the holding claw and the elastic pressing force of this holding claw have to be carefully coordinated, so as to guarantee that the pull-out system functions perfectly.

SUMMARY OF THE INVENTION

In contrast to this, an object on which the invention is based is to provide a multi-caliber firearm of the generic type mentioned above, which can be produced simply, and which affords a high degree of operating safety.

In accordance with a first aspect of the invention, a multi-caliber firearm comprises a breech, a pull-out claw at least partially disposed within the breech, and an adapter piece which is adjustably attached to the breech and which has a bearing surface formed thereon which is located radially opposite the pull-out claw. The pull-out claw is capable of selectively engaging a cartridge case having a cartridge base. The position of the adapter piece is adjustable to enable the breech to accommodate cartridge cases having different cartridge base diameters.

In accordance with another aspect of the invention, the bearing surface is formed by an edge region of an end face of the adapter piece and forms a plurality of steps ascending in a circumferential direction of the adapter piece.

In accordance with yet another aspect of the invention, the breech has a threaded bore formed therein. The adapter piece is screwed into the threaded bore and moves radially with rotation of the adapter piece. Ball catches lock the adapter piece in predetermined angular positions.

Another object of the invention is to provide a method of supporting a cartridge having a cartridge base in a breech of a firearm.

In accordance with a first aspect of the invention, the method includes the steps of engaging a first side of the cartridge with a pivotable pullout claw and adjusting the radial distance between the pull-out claw and a bearing surface of an adapter piece which is located within the breech substantially radially opposite the pull-out claw. Another step comprises supporting the cartridge base on the bearing surface of the adapter piece.

BRIEF DESCRIPTION OF THE DRAWINGS

The above and further objects of the invention will become more readily apparent as the invention is more clearly understood from the detailed description to follow, reference being made to the accompanying drawings in which like reference numerals represent like parts throughout, and in which.

DETAILED DESCRIPTION OF THE PREFERRED EMBODIMENTS

According to the invention, expenses are reduced and safety increased since the breech has, on the side located opposite the pull-out claw, an adapter piece which can be fixed in various positions and which forms an adjustable bearing surface for the cartridge base.

When the firearm is converted to accommodate another type of ammunition, the adapter piece of the breech is brought into a different position so that the bearing surface is matched to the cartridge-base diameter of the desired ammunition. When the adjustment operation is concluded, the adapter piece and its bearing surface remain rigidly in the set position, so that the bearing surface does not give way when the cartridge case is being pulled out. This guarantees a fault-free functioning of the pull-out mechanism. The production of the adapter piece with a suitably machined bearing surface and an adjustable fastening of the adapter piece to the breech can be carried out substantially more simply in manufacturing terms than the production and assembly of the resilient pull-out claw according to other known devices.

Preferably, the adapter piece is arranged rotatably in the breech, so that the bearing surface is adjusted by rotating the adapter piece about its longitudinal axis. The bearing surface can be made step-shaped at the edge of the end face of the adapter piece, so that the steps of the bearing surface which correspond to the various cartridge diameters can be rotated into the effective position on the principle of a turret. At the same time, the individual steps can be designed as plane faces extending tangentially relative to the edge of the cartridge base. Optionally, however, the steps can also have a contour which is matched to the respective circumference of the cartridge base.

Figure 1:
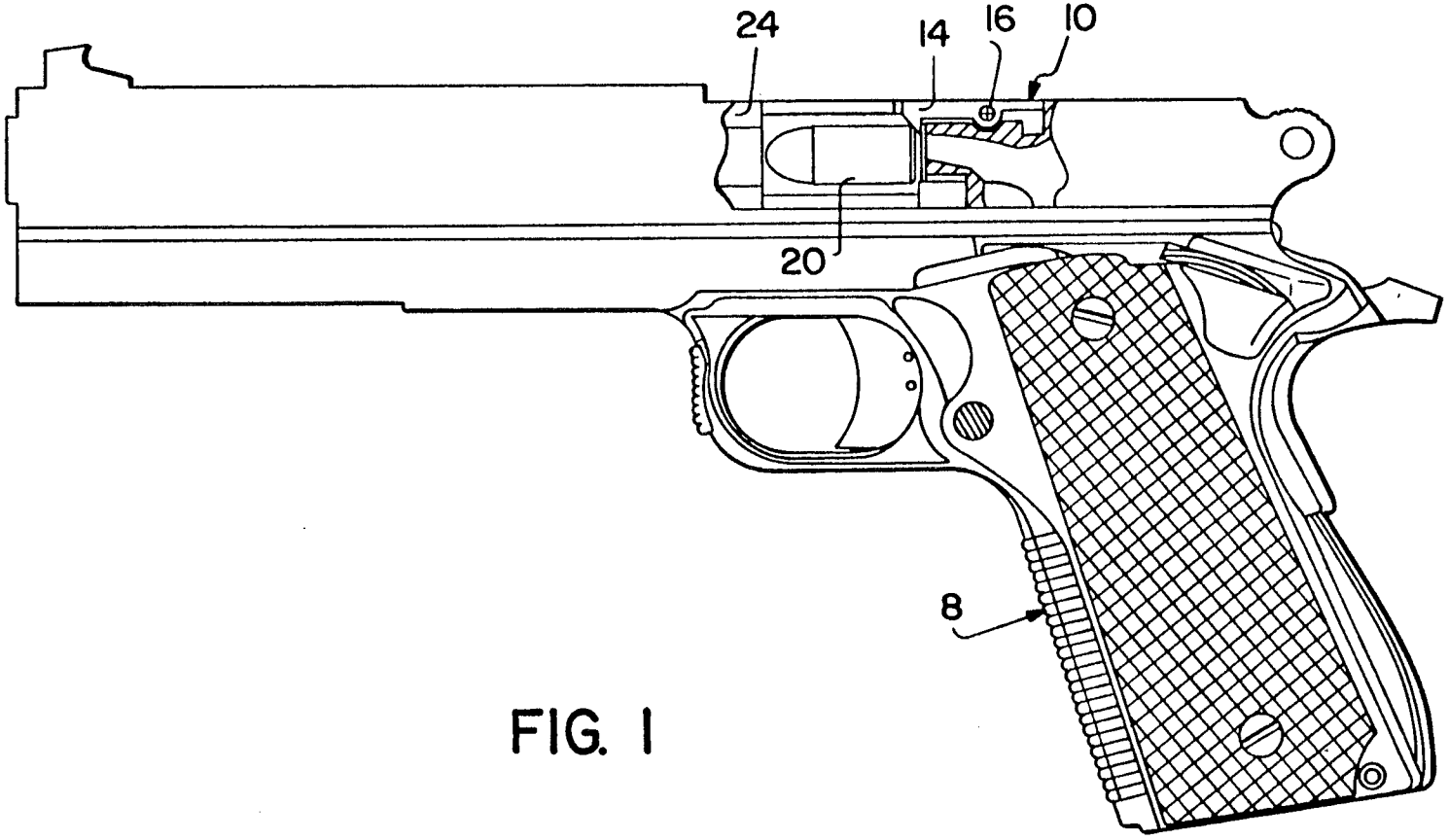
FIG. 1 illustrates a partially cut away side view of a pistol having a breech constructed in accordance with the present invention, the breech having been rotated from its actual position through 90° for the sake of illustration so that the top of the breech faces the side of the pistol.
Figure 2:
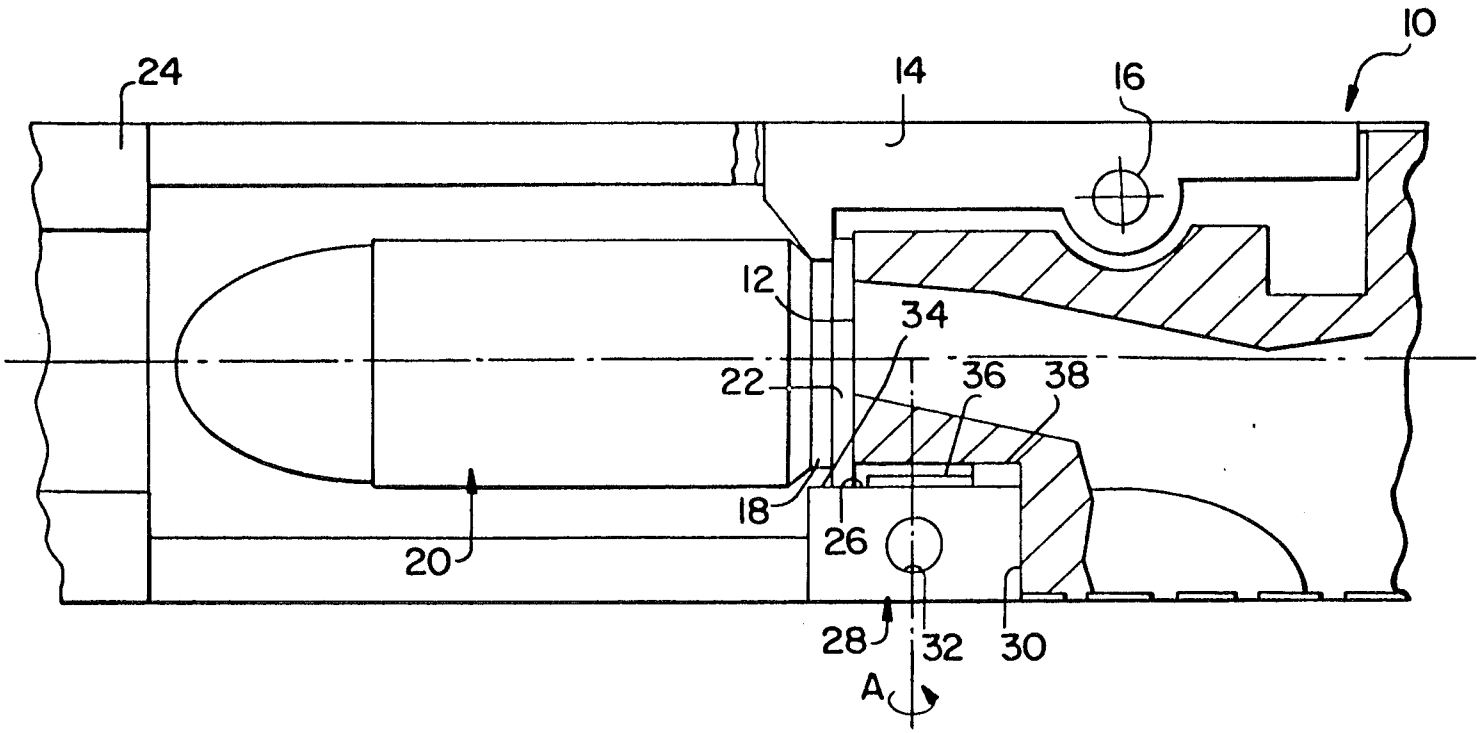
FIG. 2 shows a partially cutaway top view of the breech of the pistol of FIG. 1.

According to FIGS. 1 and 2, a breech 10 of a pistol 8 has a smooth percussion bottom 12 and a pull-out claw 14 which is pivotable about an axle pin 16 and which engages into a groove 18 of an ammunition cartridge case 20. Although the breech 10 is rotated through 90° in FIG. 1 for the sake of illustration, the illustrated portions of the breech actually face upwardly. An ammunition cartridge base 22 of cartridge case 20 is held against the percussion bottom 12 by the pull-out claw 14, so that during backward movement of the breech 10 within pistol 8, the cartridge case 20 is pulled out of the barrel 24 of the pistol. The pull-out claw 14 is prestressed into the engagement position by a spring (not shown).

A bearing surface 26, provided on breech 10, constitutes an abutment for the edge of the cartridge base 22 and prevents the cartridge base 22 from shifting towards the side located opposite the pull-out claw 14. However, the bearing surface 26 is not formed rigidly on the breech 10, but is instead located on the end face of a cylindrical adapter piece 28 which is mounted in a corresponding recess 30 of the breech. The adapter piece 28 is fixed to the breech 10, for example, by means of a pin extending through a transverse bore 32 of the adapter piece. Optionally, however, the adapter piece 28 can also be slipped onto an axle (not shown) extending coaxially through the adapter piece and can be fixed by means of a stud screw screwed into the transverse bore 32.

A further transverse bore (not shown) extending at right angles to the transverse bore 32 makes it possible to insert the adapter piece 28 into the breech 10 in four positions respectively rotated through 90° in the direction of arrow "A" relative to one another.

The bearing surface 26 forms a plurality of steps 34, 36, 38 ascending in the circumferential direction of the adapter piece. In the position shown in FIG. 2, the lowest step 34 bears against the edge of the cartridge base 22. When the firearm is to be converted to accommodate ammunition with the next smaller cartridge-base diameter, the adapter piece 28 is inserted in a position rotated through 90°, so that the step 36 is located in the effective position laterally of the percussion bottom 12. As a result of a further 90° rotation, the step 38 is brought into the effective position, so that the firearm is adapted to accommodate ammunition with an even smaller cartridge-base diameter.

Figure 3:
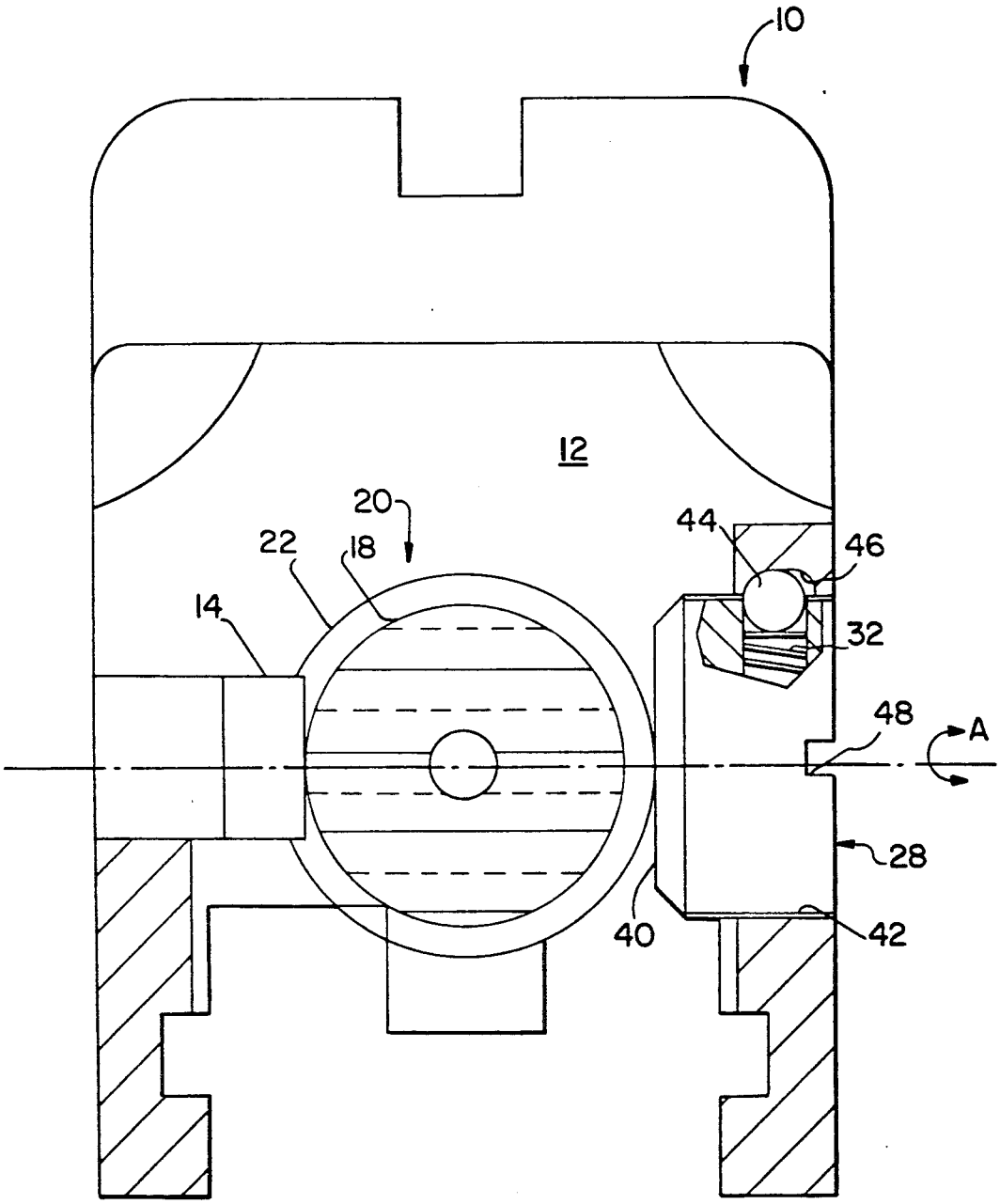
FIG. 3 shows a cross-section through the breech of a pistol and through a cartridge case held in the pull-out device at the location of the cartridge base.

A breech of a pistol according to another exemplary embodiment is shown in section in FIG. 3, the sectional plane passing through the groove 18 of the cartridge case 20 illustrated in FIG. 2.

The adapter piece can be equipped with an external thread and can be screwed into a breech bore which is equipped with an internal thread, the axis of which is directed towards the pull-out claw on the opposite radial side of the breech. In this case, the bearing surface is adjusted by screwing the adapter piece into the breech to a greater or lesser depth. Since this embodiment does not require the steps of the first embodiment, the end face of the adapter piece serving as a bearing surface can be made plane. In this case too, however, it is possible to make the bearing surface step-shaped, but then the thread pitch of the adapter piece has to be taken into account in the choice of dimensions of the steps.

The adapter piece is preferably locked in the respective desired angular positions by means of ball catches.

Insofar as the adapter piece is not in threaded engagement with the breech, a rotatable fastening of the adapter piece in the breech can be obtained if the adapter piece has a continuous grace formed on its circumference. A locking piece inserted into the breech engages the continuous groove formed in the adapter piece.

In this embodiment, the adapter piece 28 is equipped with a plane bearing surface 40 and with an external thread via which it is screwed into a threaded bore 42 of the breech 10. The axis of the threaded bore 42 is directed towards the pull-out claw 14 and extends at right angles to the projectile axis. However, the axis of bore 42 is offset downwards slightly relative to the projectile axis, in order to allow for the downward movement of the barrel and of the cartridge case 20 in relation to the breech 10 when the barrel is unlocked from the breech. A spring-loaded catch ball 44 is arranged in a transverse bore 32 of the adapter piece 28. The spring-loaded catch ball 44 engages into catch recesses 46 formed on the circumference of the threaded bore 42. When a coin, screwdriver, or the like is inserted into a slot 48 of the adapter piece 28, the adapter piece can be either screwed deeper into the breech 10 or rotated out of the breech 10 via rotation in the direction of arrow A, overcoming the catch resistance, until the catch ball 44 engages into another catch recess. The bearing surface 40 of adapter piece 51 thereby moves closer to the pull-out claw 14 or further away from this. The arrangement of the catch recesses 46 is correlated to the thread pitch of the adapter piece such that the catch positions of the adapter piece and of the bearing surface 40 correspond to the standardized cartridge-base diameters of the various types of ammunition.

In an alternative embodiment (not shown), the adapter piece can also be equipped with one or more transverse bores so that it can be fixed in the breech in specific angular positions by means of a cotter pin inserted through the breech and one of the transverse bores.

Finally, it is also possible to design the adapter piece as a prism insertable into the breech in different positions.

What is claimed is:

1. A multi-caliber firearm comprising:

(A) a breech;

(B) a pull-out claw at least partially disposed within said breech, said pull-out claw being capable of selectively engaging a cartridge case having a cartridge base;

(C) an adapter piece which is adjustably attached to said breech and which has a bearing surface formed thereon which is located radially opposite said pull-out claw, the position of said adapter piece being adjustable to enable said breech to accommodate cartridge cases having different cartridge base diameters; and (D) means for manually adjusting said adapter piece.

2. The firearm as claimed in claim 1, wherein said adapter piece is rotatable within said breech.

3. The firearm as claimed in claim 2, wherein said firearm has a projectile axis, an axis of rotation of said adapter piece extends towards said pull-out claw at right angles to said projectile axis, and said bearing surface is formed on one radial side of said adapter piece.

4. The firearm as claimed in claim 3, wherein said bearing surface is formed by an edge region of an end face of said adapter piece and forms a plurality of steps ascending in a circumferential direction of said adapter piece.

5. The firearm as claimed in claim 3, wherein said breech has a threaded bore formed therein, and wherein said adapter piece is screwed into said threaded bore.

6. The firearm of claim 3, further comprising ball catches which lock said adapter piece in predetermined angular positions.

7. The firearm as claimed in claim 3, wherein said pull-out claw and said axis of rotation of said adapter piece are vertically offset in relation to said projectile axis.

8. The firearm as claimed in claim further comprising means for holding said adapter piece in a set position when said cartridge is pulled out of said firearm.

9. The firearm as claimed in claim 8, wherein said means for holding comprises ball catches which lock said adapter piece in said set position.

10. The firearm as claimed in claim 8, wherein said adapter means has a transverse bore formed therein and wherein said means for holding comprises a pin extending through said transverse bore of said adapter piece.

11. A device for rendering a firearm capable of accommodating cartridges with different cartridge base diameters, said device comprising:

(A) a breech;

(B) a pull-out claw at least partially disposed within said breech, said pull-out claw selectively engaging a cartridge base of a cartridge to support said cartridge;

(C) an adapter piece having a bearing surface which supports said cartridge base at a location which is radially opposite said pull-out claw; and (D) means for manually adjusting said adapter piece to change the radial distance between said bearing surface and said pullout claw.

12. The apparatus as claimed in claim 11, wherein said adapter piece is rotatable within said breech, and wherein said means for adjusting comprises a plurality of steps which ascend in a circumferential direction of a face of said adapter piece, each of said steps being capable of supporting said cartridge when said adapter piece is rotated to a position permitting contact between said cartridge base and said step.

13. The apparatus as claimed in claim 11, wherein said adapter piece is rotatable within said breech, and wherein said means for adjusting comprises a threaded connection between said adapter piece and said breech which allows said adapter piece to move radially within said breech when said adapter piece is rotated.

14. The apparatus as claimed in claim 13, further comprising ball catches which lock said adapter piece in predetermined angular positions.

15. The firearm as claimed in claim 11, further comprising means for holding said adapter piece in a set position when said cartridge is pulled out of said firearm.

16. The firearm as claimed in claim 15, wherein said means for holding comprises ball catches which lock said adapter piece in said set position.

17. The firearm as claimed in claim 15, wherein said means for holding comprises a pin extending through a transverse bore of said adapter piece.

18. A method of supporting a cartridge in a breech of a firearm, said cartridge having a cartridge base, said method comprising the steps of:

(A) engaging a first side of said cartridge with a pivotable pull-out claw;

(B) manually adjusting and adapter piece which is located within said breech substantially opposite said pull-out claw, such that the radial distance between said pull-out claw and a bearing surface of said adapter piece is changed; and (C) supporting said cartridge base on said bearing surface of said adapter piece.

19. The method as claimed in claim 18, wherein said step (B) comprises the step of rotating an adapter piece, having a plurality of radial steps, from a first position in which a first one of said steps is capable of supporting said cartridge base to a second position in which a second one of said steps is capable of supporting said cartridge base, said steps ascending in a circumferential direction of a face of said adapter piece, and wherein said step (C) comprises the step of supporting said cartridge on said second one of said steps.

20. The method as claimed in claim 18, wherein said step (B) comprises the step of rotating an adapter piece, which is screwed into a threaded bore of said breech, to vary the radial distance between said bearing surface of said adapter piece and said pull-out claw.

21. The method as claimed in claim 20, wherein said step of rotating said adapter piece comprises the step of rotating said adapter piece to a predetermined angular position in which a ball catch locks said adapter piece in said predetermined position.

* * * * *